US007900575B2

(12) United States Patent
Walbridge et al.

(10) Patent No.: US 7,900,575 B2
(45) Date of Patent: Mar. 8, 2011

(54) DEPLOYABLE SEATING PLATFORM

(75) Inventors: Larry Wayne Walbridge, Grove, OK (US); Thomas Fitzgerald McKibben, Afton, OK (US)

(73) Assignee: McKibben & Walbridge Holding Company, LLC, Afton, OK (US)

( * ) Notice: Subject to any disclaimer, the term of this patent is extended or adjusted under 35 U.S.C. 154(b) by 400 days.

(21) Appl. No.: 12/133,951

(22) Filed: Jun. 5, 2008

(65) Prior Publication Data

US 2009/0301378 A1 Dec. 10, 2009

(51) Int. Cl.
*B63B 17/00* (2006.01)

(52) U.S. Cl. ..... 114/363

(58) Field of Classification Search ..... 114/362, 114/363; 182/88, 90, 91, 127
See application file for complete search history.

(56) References Cited

U.S. PATENT DOCUMENTS

| | | | | |
|---|---|---|---|---|
| 2,142,949 | A * | 1/1939 | Linker | 182/88 |
| 2,246,985 | A | 6/1941 | Pellegrini | |
| 2,809,849 | A * | 10/1957 | Benne | 182/88 |
| 3,587,123 | A | 6/1971 | O'Boyle | |
| 3,627,350 | A | 12/1971 | Cross | |
| 4,191,388 | A | 3/1980 | Barksdale | |
| 4,462,485 | A | 7/1984 | Terry et al. | |
| 4,538,314 | A | 9/1985 | Baranowski | |
| 4,722,419 | A | 2/1988 | Hoszowski | |
| 4,735,285 | A | 4/1988 | Ritten | |
| 4,768,618 | A | 9/1988 | Ritten | |
| 5,025,747 | A | 6/1991 | Grayson | |
| 5,085,164 | A | 2/1992 | Whitton | |
| 5,349,919 | A | 9/1994 | Douglass | |
| D356,289 | S | 3/1995 | Trent | |
| 5,570,654 | A | 11/1996 | Rood | |
| 5,927,433 | A | 7/1999 | Jaramillo, Sr. | |
| 6,089,174 | A | 7/2000 | Slikkers et al. | |
| 6,782,840 | B1 | 8/2004 | Garelick et al. | |
| 2007/0278039 | A1 * | 12/2007 | Sedlack | 182/91 |

* cited by examiner

*Primary Examiner* — Ed Swinehart
(74) *Attorney, Agent, or Firm* — Martin & Associates, LLC; Derek P. Martin

(57) ABSTRACT

A deployable seating platform preferably includes a base configured for attachment to a horizontal surface, such as the underside of a swimming platform on a boat. The base is coupled to a slide and pivot mechanism, which is coupled to a first end of an elongated member, with the second end of the elongated member coupled to a seat. The slide and pivot mechanism allows the elongated member to slide and pivot from a non-deployed position to a deployed position and allows the elongated member to slide and pivot from the deployed position to the non-deployed position. When in the non-deployed position, the deployable seating platform is out of the water and out of the way under the swimming platform. When in the deployed position, the seat of the deployable seating platform is in the water, providing a place for a person to sit in the water.

1 Claim, 5 Drawing Sheets

DEPLOYABLE SEATING PLATFORM

BACKGROUND

1. Technical Field

This disclosure generally relates to seats, and more specifically relates to seats that may be attached to a swimming platform on a boat.

2. Background Art

Boating is enjoyed by millions across the world. Those who enjoy boating often enjoy swimming from their boat. Many modern boats include areas known as swimming platforms that provide a flat surface close to the water and a way to easily enter and exit the water. In many such boats, the swimming platform is at the stern, close to the engine. The boat may be stopped at a desired location, the engine is then turned off, and the occupants of the boat may then enjoy swimming from the swimming platform.

On days when the weather is hot, it is easy to stay comfortable and cool while in the water, but once the person leaves the water to get on the boat, the person may become uncomfortable due to the heat. Therefore on hot days people may be inclined to spend more time in the water. Swimming can become tiring, and is not particularly suitable when a person wants to rest or relax. More restful activities might include lying on a floating pad of some type. While floating on a pad may be restful, it also takes the person out of the water and subject to the heat. What is needed is a way for a person to remain mostly submerged in the water to stay cool while in a resting position.

Another activity that is common while boating, especially on hot days, is drinking cool beverages. Drinking a beverage while swimming or while floating on a pad is difficult because there is no good place to put the drink. Thus, if a person is swimming or floating and wants a drink, he or she must typically get out of the water, get a drink, then return to the water after finishing the drink. This once again subjects the person to the heat. It would be preferable to provide a way for a person to have a drink while mostly submerged in the water to allow the person to stay cool while having a drink.

BRIEF SUMMARY

A deployable seating platform provides a place for a person to sit while in the water, thus allowing the person to be mostly submerged in the water while sitting. The deployable seating platform may be attached to a suitable surface, such as the swimming platform of a boat. When attached to a swimming platform, the swimming platform may serve as a place to rest a drink, thereby allowing a person to sit mostly submerged in the water while resting and while enjoying a drink at the same time.

The deployable seating platform is placed in a non-deployed position that is out of the water when not in use, but is easily moved to a deployed position that provides a seat in the water. The deployable seating platform provides an ideal way for a person to sit in the water mostly submerged next to the swimming platform of a boat, thereby keeping the person cool and allowing the person to enjoy a cool drink that may be placed on the swimming platform. Several such seats may be installed on a single swimming platform, allowing the swimming platform to become a floating bar for serving drinks when the seats are deployed. The result is a new and unique way to sit mostly submerged in the water and enjoy a drink at the same time.

The deployable seating platform preferably includes a base configured for attachment to a horizontal surface, such as the underside of a swimming platform on a boat. The base is coupled to a slide and pivot mechanism, which is coupled to a first end of an elongated member, with the second end of the elongated member coupled to a seat. The slide and pivot mechanism allows the elongated member to slide and pivot from a non-deployed position to a deployed position and allows the elongated member to slide and pivot from the deployed position to the non-deployed position. When in the non-deployed position, the deployable seating platform is out of the water and out of the way under the swimming platform. When in the deployed position, the seat of the deployable seating platform is in the water, providing a place for a person to sit in the water.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION

Figure 1:
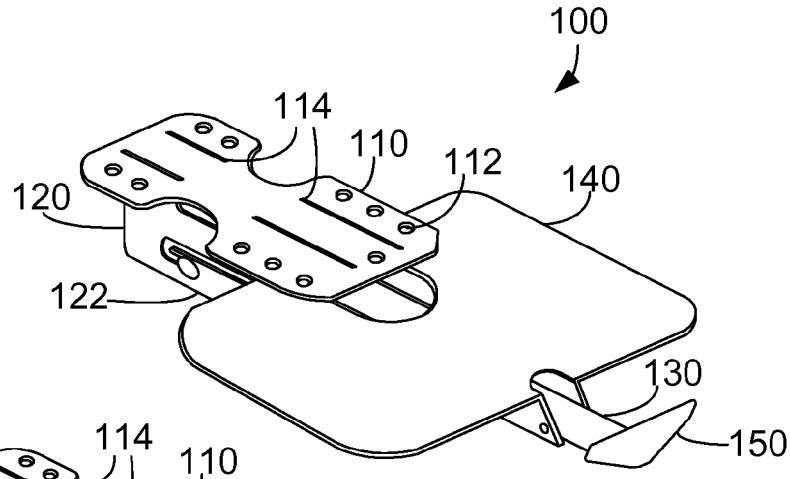
FIG. 1 is a perspective view of a deployable seating platform in a non-deployed position.

The deployable seating platform preferably includes a base configured for attachment to a horizontal surface, such as the underside of a swimming platform on a boat. The base is coupled to a slide and pivot mechanism, which is coupled to a first end of an elongated member, with the second end of the elongated member coupled to a seat. The slide and pivot mechanism allows the elongated member to slide and pivot from a non-deployed position to a deployed position and allows the elongated member to slide and pivot from the deployed position to the non-deployed position. When in the non-deployed position, the deployable seating platform is out of the water and out of the way under the swimming platform. When in the deployed position, the seat of the deployable seating platform is in the water, providing a place for a person to sit in the water.

Referring to the figures, a deployable seating platform 100 includes a base 110, a slide and pivot mechanism 120, an elongated member 130, and a seat 140. The materials used for any or all of the components in the deployable seating platform 100 may be any suitable materials, including without limitation metal, wood, plastic, carbon composite materials, other synthetic materials, etc., or any suitable combination of these materials. In the most preferred implementation shown in the figures and discussed herein, the components are made of stainless steel, which provides the needed structural integrity while resisting corrosion.

The base 110 preferably is a substantially planar member with a plurality of mounting holes 112. The plurality of mounting holes 112 allow the base 110 to be firmly attached to any suitable horizontal surface. In the most preferred implementation, bolts or screws are placed through the mounting holes 112 to attach the base 110 to the underside of a swimming platform on a boat.

Figure 3:
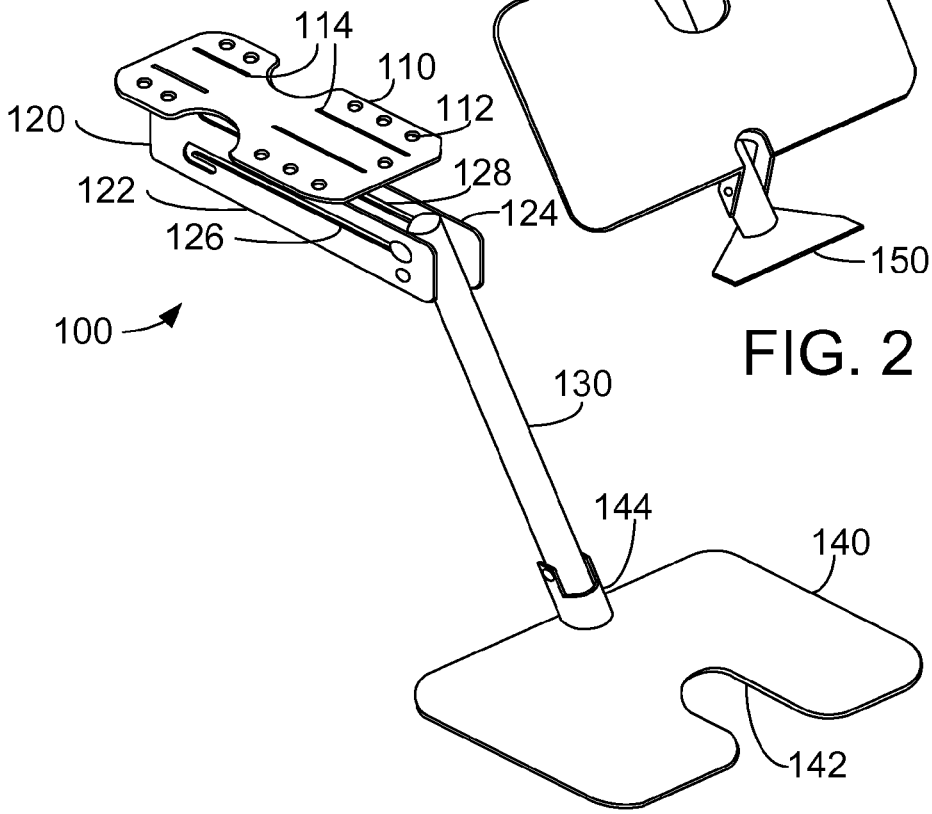
FIG. 3 is a perspective view of the deployable seating platform shown in FIGS. 1 and 2 when fully deployed.

The slide and pivot mechanism 120 is fixedly attached to the base 110. In the preferred implementation using stainless steel, the slide and pivot mechanism 120 is welded to the base 110. In the configuration shown in the figures, the base 110 includes slots 114 that receive upper portions of the slide and pivot mechanism 120 to enhance the strength of the attachment and to align the slide and pivot mechanism 120 to the proper position. The slide and pivot mechanism 120 includes two parallel side plates 122 and 124 that each include a cane-shaped slot. The term "cane-shaped" is meant herein to refer to the shape of a traditional walking cane, with an elongated straight portion and a curved U-shaped portion on the end (such as a candy cane). The cane-shaped slots have a sideways U-shaped portion on the rear end of the slide and pivot mechanism 120. The non-deployed position for the deployable seating platform 100 is shown in FIGS. 1 and 6, while the deployed position is shown in FIGS. 3 and 7.

Figure 2:
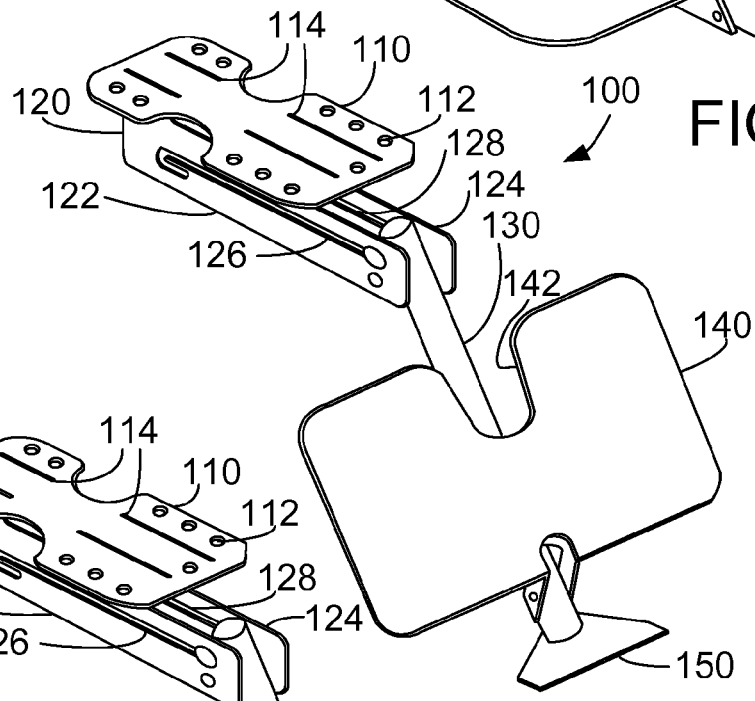
FIG. 2 is a perspective view of the deployable seating platform shown in FIG. 1 when partially deployed.
Figure 4:
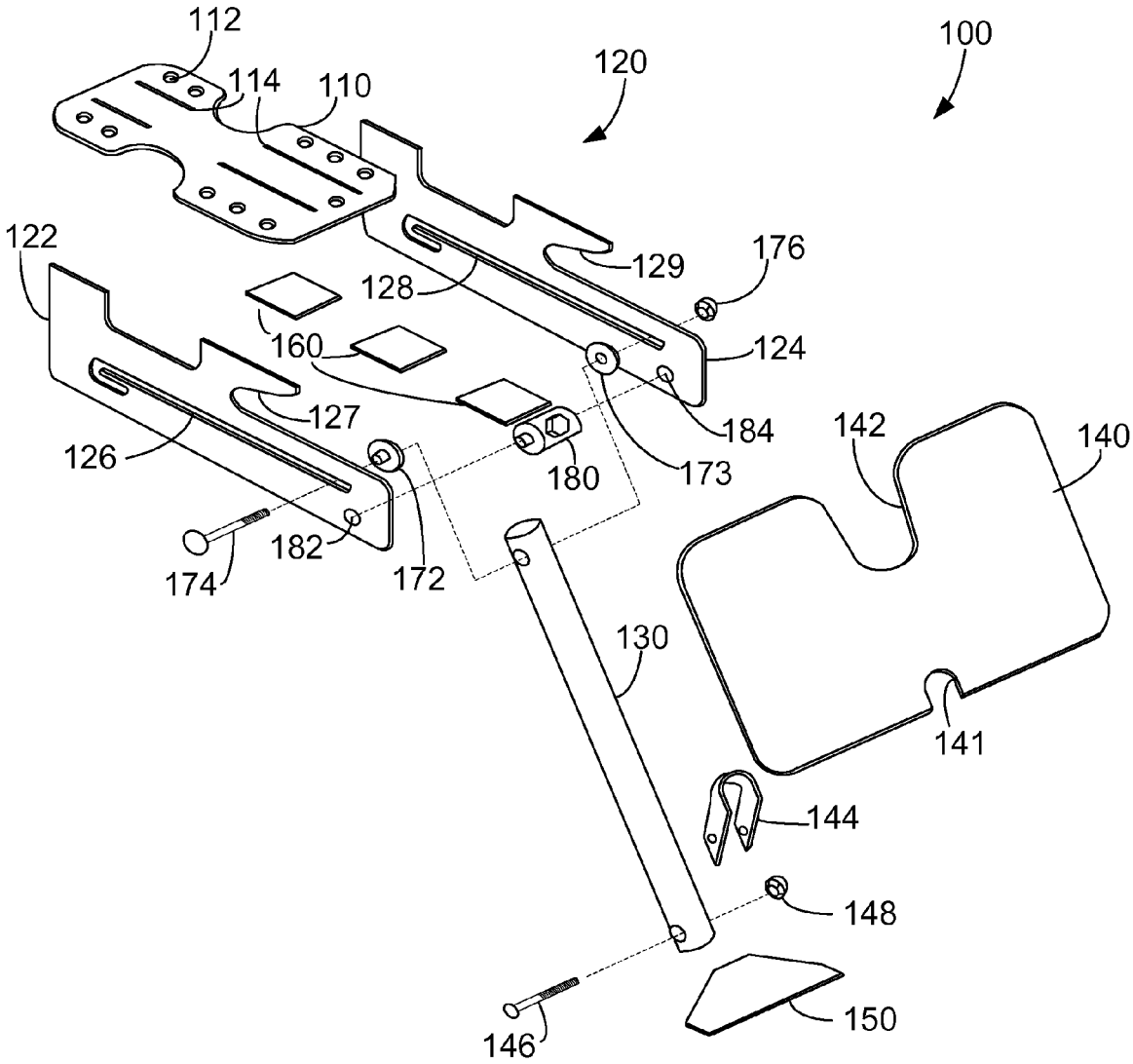
FIG. 4 is an exploded perspective view of the deployable seating platform shown in FIG. 2 showing the various components in one specific illustrative implementation.
Figure 6:
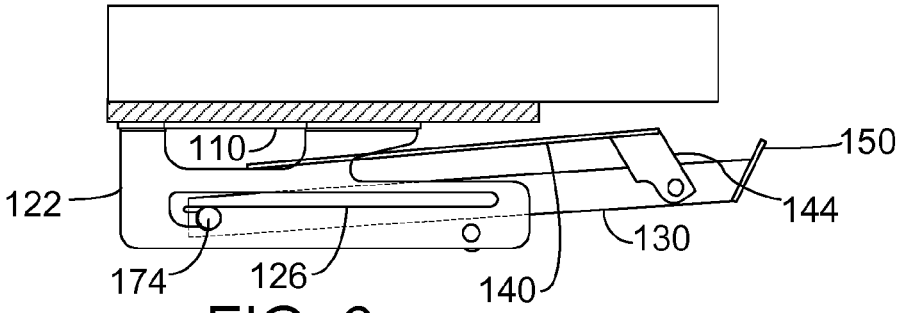
FIG. 6 is a side view of the deployable seating platform in the non-deployed position.
Figure 7:
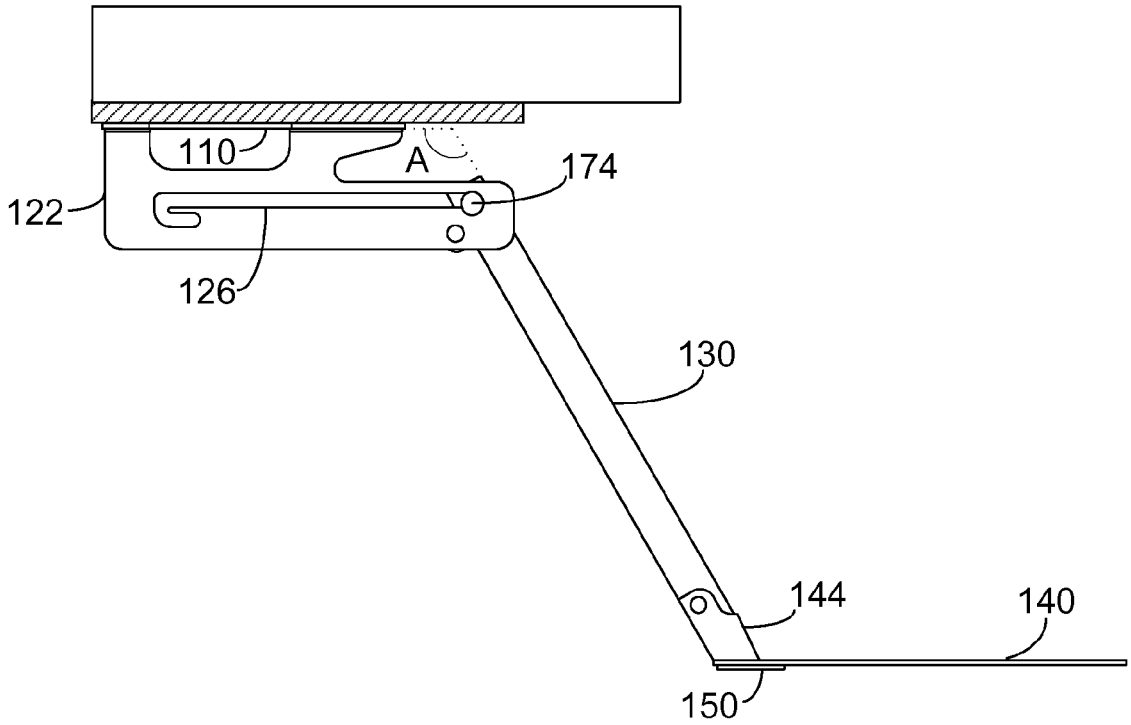
FIG. 7 is a side view of the deployable seating platform in the deployed position.

Note the seat 140 includes a first recessed portion 142 that aligns with recesses 127 and 129 in FIG. 4 when the deployable seating platform 100 is in the non-deployed position shown in FIGS. 1 and 6. The seat 142 is fixedly attached to a pivot bracket 144, which is attached to the elongated member 130 via a bolt 146 and nut 148. In the most preferred implementation using stainless steel parts, the pivot bracket 144 is preferably welded to the seat 140. Note the seat 140 also includes a second recessed portion 141 that is sized to receive the elongated member 130. The elongated member 130 has a stop plate 150 as shown in FIGS. 2 and 4 fixedly attached to its end. The stop plate 150 shown in the figures is one suitable implementation for a stop member that stops the pivoting of the seat 140 in a desired position. In the most preferred implementation, stop plate 150 is welded to the end of the elongated member 130. The stop plate provides a stop to the pivoting of the seat and holds the seat in a desired orientation when the deployable seating platform is deployed. Note the second recess 141 is preferably in the middle of a front portion of the seat, resulting in the seat being balanced left to right when moved against the stop plate 150. This allows a person who wants to sit on the seat to use the seat in two different ways. The first way is for the person to place the elongated member 130 between the legs as the person sits down, which allows the person to face the direction of the base 110 while sitting. This position is especially useful when the deployable seating platform 100 is attached to the lower surface of a swimming platform on a boat. The person, by sitting on the seat 140 with the elongated member 130 between the legs, essentially "bellys up" to the swimming platform as if the swimming platform is a bar. The person can then put a drink on the swimming platform, and enjoy a cool beverage while mostly submerged in the water due to sitting on the seat 140. The second way for a person to use the deployable seating platform 100 is to sit on the seat 140 facing away from the base 100. In this position, the person can recline back against the elongated member 130, and may relax while sitting on the seat 140. An optional pad could be wrapped around the elongated member 130 to provide a padded backrest. In the alternative, a rectangular pad could be clipped using plastic C-shaped clips to the elongated member 130, thereby providing a more comfortable back rest.

The elongated member 130 is shown in the figures as a linear tubular member, which in the most preferred implementation is made of stainless steel. Note, however, the elongated member may be any arm or other member that is any suitable size, cross-section, shape, or configuration, as long as the elongated member 130 allows the deployable seating platform 100 to move from the non-deployed position to the deployed position, and back.

Figure 8:
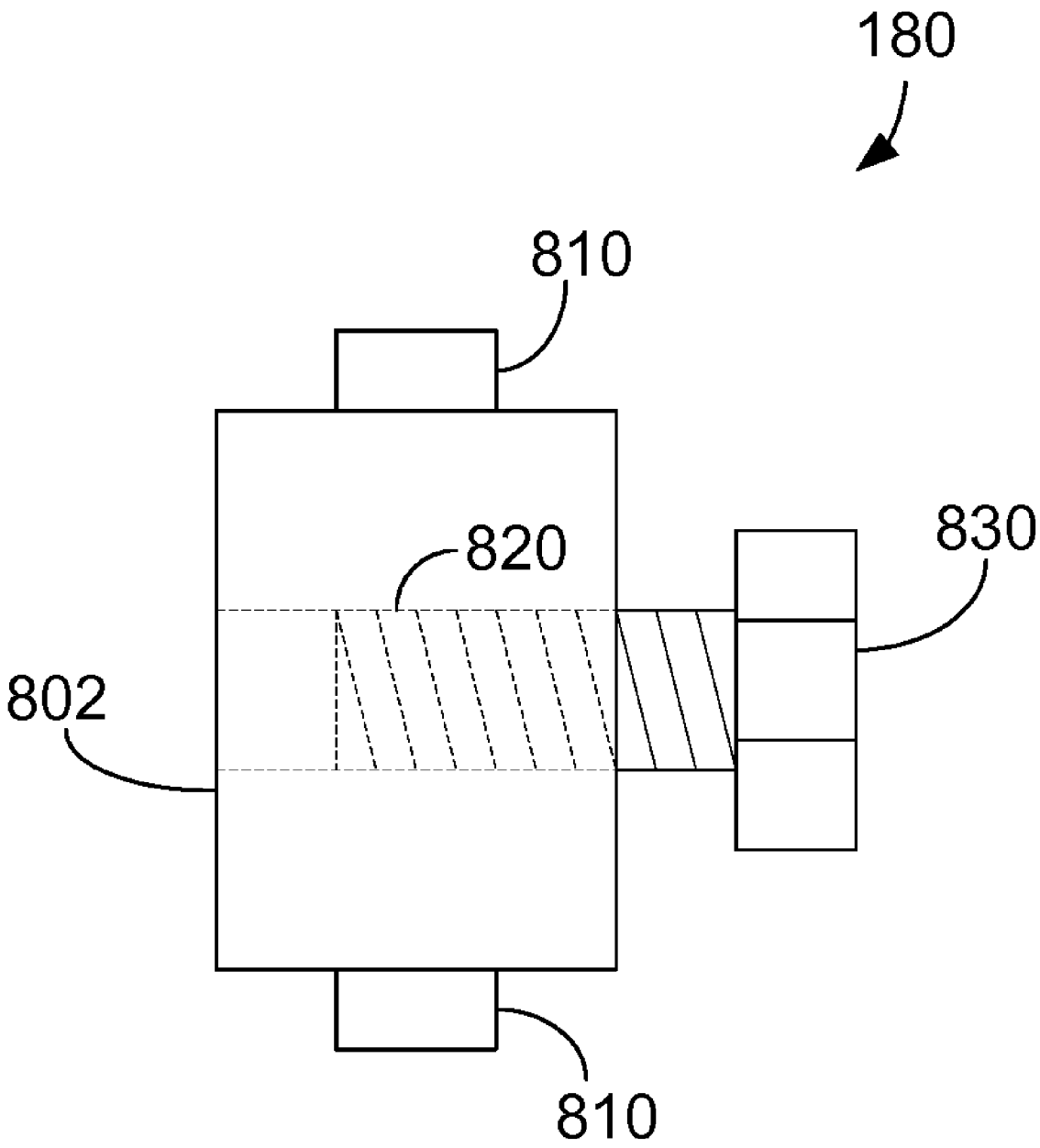
FIG. 8 is a top view of the pivot stop shown in FIG. 4.

FIG. 4 shows additional pieces that are used to fabricate one specific implementation of the slide and pivot mechanism 120. Note the slide and pivot mechanism 120 in the particular implementation shown in FIG. 4 is a slide receiver with parallel members that have opposing slots that allow the elongated member 130 to slide with respect to the slide receiver. The slide receiver 120 in FIG. 4 includes gussets 160 that are spacers that attach the two side plates 122 and 124 to each other. In the most preferred implementation using stainless steel parts, the gussets 160 are welded to the two side plates 122 and 124. Also shown in FIG. 4 are bushings 172 and 173 which have a full diameter portion and a reduced diameter portion. The reduced diameter portion is sized slightly smaller than the width of the slots 126 and 128 so the bushings 172 may slide within the slots. A bolt 174 passes through slot 126, through the reduced diameter portion of bushing 172 and out the full diameter portion, through a hole in the elongated member 130, through a full diameter portion of bushing 173 out the reduced diameter portion, through slot 128, into a nut 176. The spacing between the side plates 122 and 124 of the slide receiver shown in FIG. 4 and the length of a threaded portion of the bolt 174 are such that the nut 176 may be tightened onto bolt 174, which captivates a first end of the elongated member 130 between the bushings 172 and 173 while still allowing the bushings 172 and 173 to slide within the respective slots 126 and 128. The bolt 174 thus serves as a pivot member that allows the elongated member 130 to pivot in a downward direction when the pivot member is in the front portion of the slots 126 and 128. A pivot stop 180 is also shown in FIG. 4, and includes a cylindrical body 802 with reduced diameter portions 810 at each end, as shown in FIG. 8. The reduced diameter portions 810 are inserted into holes 182 and 184 (FIG. 4) during assembly of the slide receiver, resulting in the pivot stop 180 being captivated between the side plates 122 and 124. The pivot stop 180 is preferably fixedly attached to the side plates 122 and 124 (e.g., via a weld). The pivot stop 180 allows the elongated member 130 to pivot downward to a desired position when the elongated member 130 is slid so the bolt 184 is at the front end of the slots 126 and 128 (e.g., in the deployed position), but provides a stop so the pivoting motion of the elongated member 130 is restrained to a desired position even when a person sits on the seat 140. In the preferred implementation shown in the figures, the pivot stop 180 holds the elongated member 130 at an obtuse angle A with respect to a line extending from the front of the base to the back of the base, as shown in FIG. 7. Referring again to FIG. 8, pivot stop 180 preferably includes a threaded portion 820 for receiving a bolt 830. The bolt 830 allows adjustment of the pivot stop, thereby allowing a user of the deployable seating platform to adjust the angle A of the elongated member 130 with respect to the base 110. Note that threaded portion 820 preferably provides a slight interference fit with the threads of bolt 830, allowing the bolt 830 to remain in a desired position without allowing the bolt 830 to move in or out via vibrations. Pivot stop 180 is a stop member that stops the pivoting travel of the elongated member 130 in the downward direction.

Figure 5:
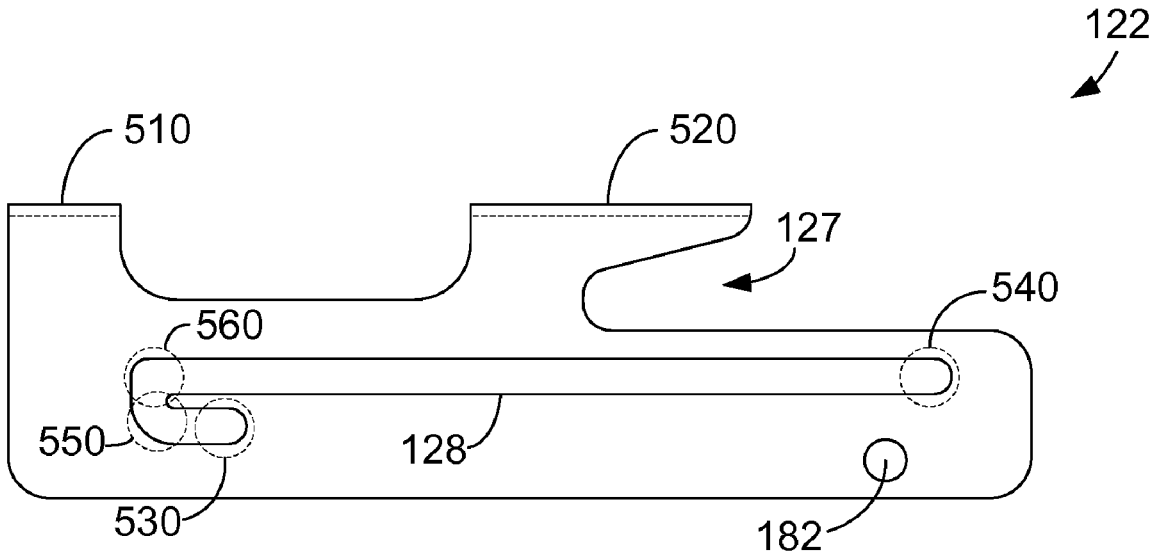
FIG. 5 is a side view of one of the side members shown in FIG. 4.

A side view of the left side plate 122 is shown in FIG. 5. For the particular implementation shown in the figures, the right side plate 124 shown in FIG. 4 is identical to the left side plate 122. As discussed above, top portions 510 and 520 show by dotted lines in FIG. 5 preferably slide into the slots 114 in the base 110 before welding to strengthen the joint between base 110 and side plate 122. The cane-shaped slot 128 provides a path for the bolt 174 to slide. Because bolt 174 is coupled to the first end of the elongated member 130, the elongated member can pivot about the bolt 174 and slide within the slide receiver between a non-deployed position and a deployed position. When the elongated member 130 and seat 140 are in a non-deployed position, as shown in FIGS. 1 and 6, the head of the bolt 174 is in the lower portion of the sideways U-shape in the slot 126, as shown by the dotted circle 530 in FIG. 5. When the elongated member 130 is in a deployed position, as shown in FIGS. 2-4 and 7, the head of the bolt 174 is in the right end of the slot, as shown by the dotted circle 540 in FIG. 5.

The deployment of the deployable seating platform 100 is now described. We assume the seating platform is in a non-deployed position, as shown in FIGS. 1 and 6, with a head of the bolt in position 530 shown in FIG. 5. In this position, the seating platform 100 is held in the non-deployed position. Any force on the deployable seating platform that might tend to deploy the platform, such as from water running under a boat, will not deploy the deployable seating platform because the bottom portion of the sideways U-shape does not allow the bolt to move in that direction. To deploy the deployable seating platform that is mounted on the underside of a swimming platform on a boat, a person who is preferably in the water places a hand on the stop plate 150, pushes in to force the bolt to the bottom of the sideways U-shape of the slot (as shown at 550 in FIG. 5), then pulls down on the stop plate 150 to push the bolt into the upper portion of the slot (as shown at 560 in FIG. 5), then pulls out on the stop plate 150 to slide the bolt to position 540 in FIG. 5, which allows the elongated member 130 to pivot downwardly until the elongated member 130 contacts the pivot stop 180. At this point, the seat is still in a non-deployed position, as shown in FIG. 2. The person then pivots the seat downwardly until the seat hits the stop plate 150, resulting in the deployable seating platform 100 being in the deployed position shown in FIGS. 3 and 7. When a person is done using the deployable seating platform, the person first pivots the seat from the deployed position shown in FIG. 3 to the non-deployed position shown in FIG. 2. The person then lifts on the pivot plate 150 to pivot the elongated member 130 upward. While lifting, the person may also push in on the pivot plate 150, resulting in the bolt sliding within the slots. Once the bolt reaches the bottom of the sideways U-shape in the slot as shown at 560 in FIG. 5, it falls by force of gravity to the lower portion of the sideways U-shape, as shown at 550 in FIG. 5. The person may then pull on the pivot plate 150 to make sure the bolt is in the non-deployed position shown at 530 in FIG. 5. From the description above, it is clear the stop plate 150 performs the dual role of stopping the pivot of the seat 140 as well as providing a handle that allows a person to easily move the deployable seating platform from a deployed to a non-deployed position, then back to the deployed position.

While FIG. 4 shows many separate parts in the preferred implementation using stainless steel parts and using welding to fasten the parts together, one of ordinary skill in the art will appreciate the slide and pivot mechanism 120 could be fabricated in a variety of different ways. For example, the base 110 and side plates 122 and 124 could be formed simultaneously via an extrusion process, such as from an aluminum extrusion. In addition, various components shown in FIG. 4 could be molded together using natural or synthetic materials. The disclosure and claims herein expressly extend to any suitable way to manufacture a base coupled to a slide and pivot mechanism that attaches to a first end of an elongated member, with a second end of the elongated member attaching to a seat.

While the deployable seating platform is described herein as being attached to the swimming platform of a boat, many other uses are also within the scope of the disclosure and claims herein. For example, a portable trailer could include many deployable seating platforms mounted to the underside of a flat trailer deck, thereby providing a portable platform for feeding or providing drink to many people at the same time. In addition, the deployable seating platform could be used to provide bar stools that are attached to the underside of a bar. When the floor underneath the bar needs to be cleaned, the deployable seating platforms could be placed in their non-deployed positions, thus allowing easy cleaning of the floor without interference from traditional barstools. A boat or recreational vehicle (RV) could also include one or more deployable seating platforms to provide seating that is attached to the boat or RV. The deployable seating platform could also be attached to a dock, or to the tailgate of a pickup truck. In addition, while the specific configuration shown in the figures herein is for attaching to the underside of a flat platform, many other configurations are possible. For example, the base could be configured to attach to a vertical surface, or could be configured to attach to the top side of a horizontal surface. In addition, the slide and pivot mechanism could provide a slide in one direction and a pivot in a different direction. For example, the slide and pivot mechanism could allow the elongated arm to pivot in a first direction, such as to a sideways position, then slide in a second direction, or to slide in a first direction, then pivot. In summary, the disclosure and claims herein expressly extend to any suitable configuration for a deployable seating platform that includes a base, a slide and pivot mechanism coupled to the base, and an elongated member coupled at one end to the slide and pivot mechanism and at the other end to a seat.

The disclosure and claims here provide a deployable seating platform that may be stored in a collapsed configuration in a non-deployed position, but may be easily deployed to provide a seat for a person. When attached to the underside of a swimming platform on a boat, the deployable seating platform provides a seat in the water when in the deployed position where a person can sit mostly submerged in the water facing the swimming platform. The result is a seat that provides the feel of a barstool, with the swimming platform of the boat serving as a bar to hold a drink the person on the seat is drinking.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. An apparatus comprising:

a substantially planar base having a plurality of mounting holes in a plane for attaching the base to a horizontal surface;

a slide receiver fixedly attached to the base, wherein the slide receiver comprises two parallel members having opposing cane-shaped slots that have a first linear portion and a sideways U-shaped portion at a rear of the slide receiver, the slide receiver further including opposing recessed areas in the two parallel members and an adjustable first pivot stop;

at least one member coupling the two parallel members of the slide receiver;

an arm having a first end coupled to the slide receiver in a manner that allows the arm to slide from a non-deployed position to a deployed position as the arm is slid in a first direction along the slide receiver and that allows the arm to slide from the deployed position to the non-deployed position as the arm is slid in a second direction along the slide receiver opposite the first direction, and wherein the at least one portion of the arm coupled to the slide receiver comprises a first member extending through the first end of the arm and through the opposing slots in a manner that allows the first member to slide in the opposing slots, wherein the arm pivots with respect to the slide receiver when the arm is in the deployed position, the arm resting against the first pivot stop in the slide receiver when the arm is in the deployed position at an obtuse angle with respect to a line extending from a front of the base to a rear of the base when the arm is in the deployed position;

a seat having a front portion pivotally coupled to a second end of the arm opposite the first end, the seat providing a place for a person to sit when the arm is in the deployed position, the seat including a recessed portion that lies in the recessed areas in the parallel members of the slide receiver when the arm is in the non-deployed position; and a seat stop fixedly coupled to the second end of the arm in a position that stops the pivoting of the seat in a desired position for sitting when the arm is in the deployed position.

* * * * *